United States Patent [19]

Reece

[11] Patent Number: 4,489,445

[45] Date of Patent: Dec. 25, 1984

[54] METHOD AND CONSTRUCTION OF UNITARY WELT AND FLAP FOR A POCKET OPENING

[76] Inventor: John B. Reece, 54 Fairgreen Pl., Chestnut Hill, Mass. 02167

[21] Appl. No.: 565,594

[22] Filed: Dec. 27, 1983

[51] Int. Cl.[3] ..... A41D 17/02; A41D 27/20

[52] U.S. Cl. ..... 2/247; 2/243 B

[58] Field of Search ..... 2/247, 243 B, 248–254

[56] References Cited

U.S. PATENT DOCUMENTS 1,945,104 1/1934 Zilinsky .
2,675,560 4/1954 Bufardeci .
3,335,682 8/1967 Tucci .
4,321,710 3/1982 Ott ..... 2/247
4,451,318 5/1984 Ott ..... 2/243 B

FOREIGN PATENT DOCUMENTS 1363564 of 0000 France .

*Primary Examiner*—Doris L. Troutman

[57] ABSTRACT

This invention relates to a welted pocket opening provided with a flap and to the method of forming the welt and flap from a single piece of material which has been precut from the supply of material.

10 Claims, 11 Drawing Figures

METHOD AND CONSTRUCTION OF UNITARY WELT AND FLAP FOR A POCKET OPENING

BACKGROUND OF THE INVENTION

In the manufacture of garments the conventional method of producing pocket openings is to cut two pieces from the main supply of material, one a welt forming piece and a second flap forming piece. A flap lining piece is then secured to the flap forming piece in a manner to present a finished appearance of the flap edges when it is attached to the garment.

The welt forming piece is first placed face down on the face of the main garment panel and folded into an inverted T-shape. The flap forming piece is then placed in position on one side of the folded welt forming piece over one half of the cross arm of the T-shape. Two rows of stitches are then applied to secure the flap and welt pieces to the main garment panel with one row of stitches passing through the flap forming piece, the double fold of one side of the cross arm and through the main garment panel and with the other row of stitches passing through the double fold of the other cross arm and the main garment panel. A slit is then made in the welt forming piece and the garment panel between the two rows of stitches and between the vertical legs of the inverted T-shaped welt. Then the welt forming piece is turned through the slit with the cross arm portions now extending toward each other from the opposite sides of the slit to substantially close the slit.

If desired the flap forming piece can be first placed on the main garment panel at the desired location and the welt forming piece then placed on top of the flap forming piece with the folding, sewing and slitting to be performed as above. Care must be taken to prevent the flap forming piece from extending across the area in which the slit is to be formed.

As is apparent in the above construction and method it is necessary for the operator to control three separate parts during the placing, folding and sewing operations. This requires skill and dexterity as well as extra time to ascertain that all parts are correctly aligned prior to sewing and cutting to prevent the production of defective garments.

SUMMARY OF THE INVENTION

The object of this invention is to provide a welted pocket opening having a flap in which the welt and flap are integral with each other but have a finished appearance in the completed garment resembling a two piece welt and flap construction.

Another object of this invention is to form a welted pocket opening having a flap in which the welt and flap are formed from a single piece cut from the main supply of material.

A further object of this invention is to simplify the parts handling in the formation of welted pocket openings having a flap.

These and other objects and advantages of the present invention will become more readily apparent from the following detailed description of the preferred embodiments and from the accompanying drawings.

DESCRIPTION OF THE DRAWINGS AND PREFERRED EMBODIMENT

Figure 1:
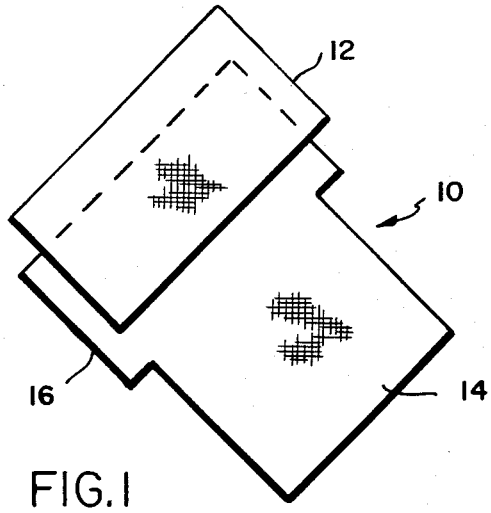
FIG. 1 is an exploded perspective view showing the welt and flap forming piece and the flap lining piece of this invention.

Referring now to FIG. 1 there is indicated generally at 10 a single piece of material which is to form both the welt and the flap for a finished pocket opening in a garment panel. The piece of material is cut in a substantially T-shape with the leg 14 of the piece of material forming the welt for the finished pocket opening and the cross arm portion 16 forming the flap for the finished pocket opening. A separate piece of lining material 12 is shown in overlying position on the cross arm or flap forming portion 16.

Figure 2:
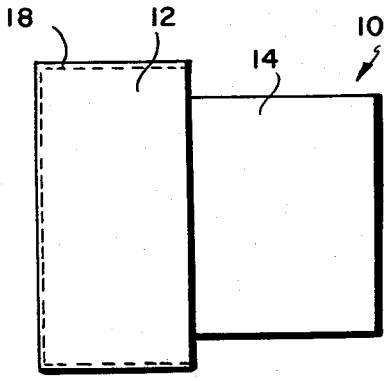
FIG. 2 is a top plan view showing the flap lining piece sewn in position on the welt and flap forming piece.
Figure 3:
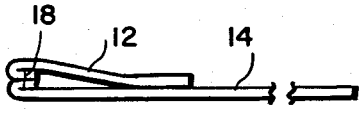
FIG. 3 is a cross sectional view showing the flap lining piece turned to its finished position on the welt and flap forming piece.

The piece of material 10 is placed face up and the piece of lining material 12 is placed face down over the cross arm portion 16 as seen in FIG. 2. A row of stitches 18 is then applied around the three free sides to secure the lining 12 to the cross arm portion 16. The lining 12 and the cross arm portion 16 are then inverted resulting in the structure show in FIG. 3. Thus the face of the cross arm portion 16 and the face of the lining 12 are exposed and the raw edges of each are disposed inwardly and covered by the lining and flap material. If desired the cross arm portion 16 can be lengthened whereby it can be doubled back upon itself thus replacing the lining material 12 to provide the final finished appearance in the completed pocket opening.

Figure 4:
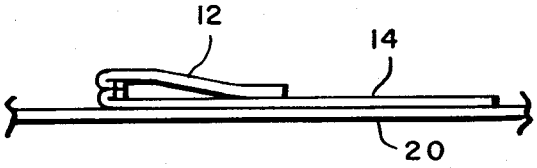
FIG. 4 is a cross sectional view showing the initial positioning of the welt and flap forming piece on the main garment panel.
Figure 5:
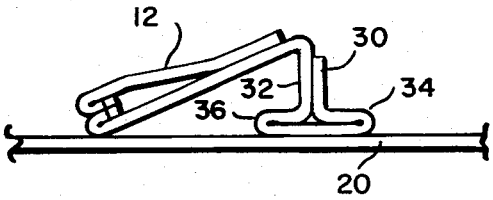
FIG. 5 is a cross sectional view showing the forming of the initial fold in the welt area of the welt and flap forming piece for a double welt construction.

The flap and welt forming piece 10 is placed face down on the face of the garment panel 20 at the desired location as shown in FIG. 4. The welt forming piece is then formed into an inverted T-shape with the center of the cross arm being located along the longitudinal center line of the finished pocket opening.

The inverted T-shape is formed by folding the free edge of the welt portion back upon itself forming the fold 34 as one side edge of the cross arm, as seen in FIG.

5, and then upwardly forming the vertical leg 30. The welt portion lying between the center line of the pocket and the flap portion is also folded back upon itself forming the fold 36 as the other side edge of the cross arm and is then turned upwardly forming the vertical leg 32 extend parallel to leg 30 and which leg 32 now has one edge of the flap portion suspended from its upper end. The folding for achieving the folds 34 and 36 as well as for achieving legs 30 and 32 can be accomplished either sequentially or simultaneously.

Figure 6:
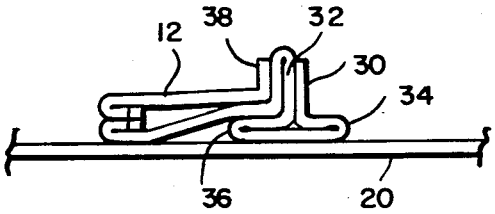
FIG. 6 is a cross sectional view showing the fold in the flap portion of the welt and flap forming piece.
Figure 7:
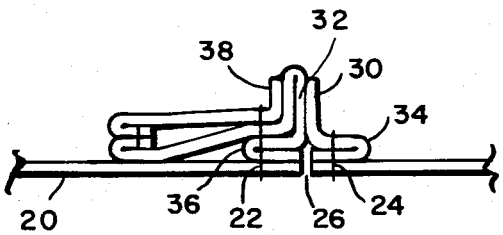
FIG. 7 is a cross sectional view showing the stitching securing the welt and flap forming piece to the main garment panel as well as the slit cut in the welt area and through the main garment panel.

As seen in FIG. 6, the flap portion adjacent leg 32 is next tucked in against the leg 32 to provide a vertical leg 38 on the flap portion which is parallel to the legs 30 and 32. Thus the flap portion now assumes a substantially L-shape with the main portion lying flat on the main garment panel 20 and overlying the cross arm portion formed by the fold 36 with a vertical leg 38 extending upwardly in parallel relation to the legs 30 and 32 of the welt portion with the upper ends of the legs 38 and 32 being a continuation of one another. The formation of leg 38 can take place either subsequent to the formation of leg 32 or can be formed simultaneously with the formation of leg 32.

After the flap and welt forming piece has been folded into the position shown in FIG. 6, the flap and welt forming piece is secured to the main garment panel 20 by means of two rows of stitches 22 and 24. The row of stitches 22 passes through the flap lining material the horizontal portion of the flap, both layers of the cross arm formed by the fold 36 and the main garment panel 20, while the row of stitches 24 passes through both layers of the cross arm formed by the fold 34 and the main garment panel 20. The vertically extending legs 30, 32 and 38 will be disposed between the lines of stitches 22 and 24.

A longitudinally extending slit 26 is cut through the garment panel 20 and the center or the cross arm of the T-shaped welt portion. The slit 26 is located centrally of the legs 30 and 32. The stitching of the two rows of stitches 22 and 24 and the cutting of the slit 26 can take place sequentially or simultaneously.

Upon completion of the sewing of stitch rows 22 and 24 and the cutting of the slit 26, the legs 30, 32 and 38 are turned through the slit 26 to the reverse side of the main garment panel 20. The major portion of the flap 16 is allowed to remain on the face side of the main garment panel 20.

Figure 8:
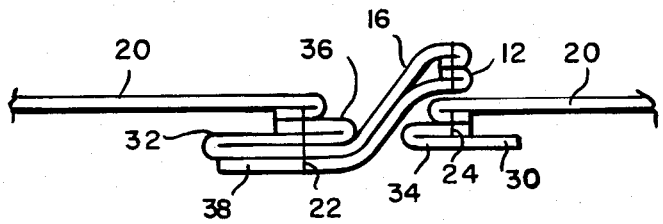
FIG. 8 is a cross sectional view showing the welt turned through the slit with the flap extending across the welted opening.

As will be apparent from FIG. 8 when viewed from the face of the main garment panel 20 all exposed edges will be finished in appearance with only the face of the material being visible on all exposed parts. Further the folds 34 and 36 now extend toward each other from opposite sides of the pocket opening to form the welts for the pocket opening. The flap 16 likewise extends from behind the welt formed by fold 36, between the two welts and over the welt formed by fold 34 to extend beyond the pocket opening on the side opposite the side to which it is attached.

Figure 9:
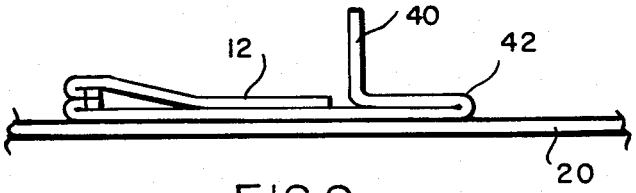
FIG. 9 is a cross sectional view of the placement and folding of the welt and flap forming piece for a single welt construction.

The above description applies to a pocket opening having a double welt construction with a flap. If it is desired to have a pocket opening with a single welt construction the sequence is shown in FIGS. 9, 10 and 11.

In this alternate form of construction the flap lining 12 is attached to the flap portion 16 and inverted to present finished edges and the completed flap and welt forming piece is placed face down on the main garment panel 20 in the same manner as in the double welt construction.

The free edge of the welt formng portion is folded back upon itself to form the fold 42 which forms a cross arm and then turned upwardly to form an upstanding leg 40. This portion is similar to the corresponding portion of the T-shape in the previous construction. The row of stitches 24 secures the both layers of fold 42 in position on the main garment panel. A second row of stitches 28 extending parallel to the row of stitches 24 passes through the flap lining 12 the flap portion 16 and the main garment panel 20. A slit 26 is cut in the main garment panel 20 and the welt portion between the rows of stitches 24 and 28. The stitching and cutting can be accomplished either sequentially or simultaneously.

Figure 10:
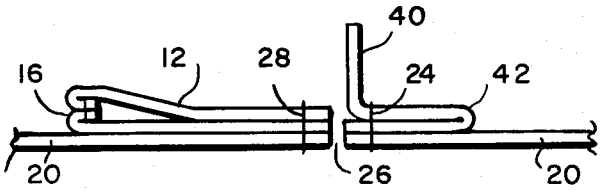
FIG. 10 is a cross sectional view showing the stitching and the slit for the single welt construction.
Figure 11:
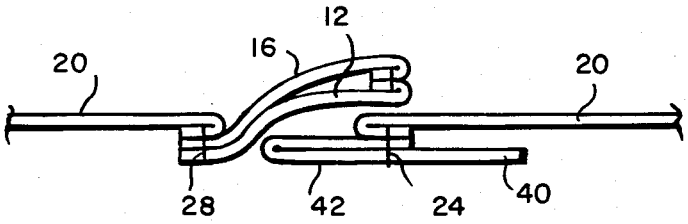
FIG. 11 is a cross sectional view showing the single welt turned through the slit and the welt extending across the pocket opening.

Upon completion of the cutting and stitching shown in FIG. 10 the fold 42 and the edge of the flap adjacent stitches 28 are turned through the slit 26 to the reverse face of the main garment panel 20. This results in the structure of FIG. 11 wherein the fold 42 forms a welt extending across the pocket opening from one side and the flap 16 extends across the pocket opening from the opposite side and extends beyond the pocket opening. The flap 16 will be fastened by the row of stitches 28 to the rolled under portion of the main garment panel 20 whereby only finished edges on all exposed parts will be visible.

It is understood that the invention is not limited to the embodiments shown and described, but many changes and modifications can be made without departing from the invention as defined in the appended claims.

What is claimed is:

1. A flap covered pocket opening for a garment comprising, a main garment panel having an opening formed therein, the edges of said opening being turned back upon the reverse side of said pocket opening, said opening being covered by welting material extending across said opening, said welting material having at least one folded edge lying within the said opening, said welting material being secured to the reversed edges of said opening, said opening being covered by a piece of material which forms a flap extending across said opening, said flap material being secured to a reversed edge of said opening and extending over the welting material secured to the opposite edge of said opening and, said flap material and said welting material being integral with each other.

2. A pocket opening according to claim 1 wherein, said welting material has two folded edges lying within the opening in abutting relation to each other said welting material having one folded edge secured to the reversed edge of one side of said opening and the other folded edge secured to the reversed edge of the other side of said opening and said flap material being a continuation of said welting material on one side of said opening with said flap material and said welting material being secured to said reversed edge of the opening by a single row of stitches.

3. A method of forming the welt and flap for a pocket opening in a main garment panel comprising, cutting a unitary welt and flap forming piece having welt and flap forming portions of predetermined size and shape from a supply of material, placing said welt and flap forming piece face down on the main garment panel in predetermined position, turning the edge of the welt forming portion opposite the flap forming portion back upon itself and then vertically in a direction away from said main garment panel, turning the edge of the welt forming portion which is attached to the flap forming portion back upon itself and then vertically in a direction away from said main garment portion whereby the welt forming portion forms an inverted T-shape with the cross arm resting on said main garment panel, tucking the flap forming portion adjacent the attached welt forming portion against the vertical portion thereof to form an L-shaped having the main body of the flap portion lying parallel to said main garment panel, sewing rows of stitches, one on each side of the vertical portions of the welt and flap portions, to secure the folded welt and flap forming piece in position on the main garment panel, cutting a slit centrally of the cross arm of the inverted T-shape and the rows of stitches through both the welt forming material and the main garment panel, and turning the welt forming portion through the slit to the reverse face of the main garment panel with the main body of the flap forming portion remaining on its original side of the main garment panel and extending across the opening formed by the slit.

4. The method of forming the welt and flap for a pocket opening according to claim 3 wherein, the turning back of the opposite edges of the welt forming portion to form the vertical legs is done simultaneously.

5. The method of forming the welt and flap for a pocket opening according to claim 3 wherein, the turning back of the opposite edges of the welt forming portion to form the vertical legs and the tucking of the adjacent flap portion is done simultaneously.

6. The method of forming the welt and flap for a pocket opening according to claim 3 wherein, the sewing of both rows of stitches takes place simultaneously.

7. The method of forming the welt and flap for a pocket opening according to claim 6 wherein, the cutting of the slit takes place simultaneously with the stitching of the rows of stitches.

8. A method of forming the welt and flap for a pocket opening in a main garment panel comprising, cutting a unitary welt and flap forming piece having welt and flap forming portions of predetermined size and shape from a supply of material, placing said welt and flap forming piece face down on the main garment panel in predetermined position, turning the edge of the welt forming portion opposite the flap forming portion back upon itself and then vertically in a direction away from said main garment panel, sewing a first row of stitches through both layers of the folded flap portion and the main garment panel along a line closely adjacent the vertically disposed portion, sewing a second row of stitches through the unfolded welt portion and the main garment panel which row is parallel to and spaced from said first row of stitches in a direction toward the flap portion, cutting a slit through the unfolded welt portion and the main garment panel and which slit is located between the rows of stitches and is parallel thereto, and turning said welt portion through the slit to the reverse face of the main garment panel with the flap forming portion remaining on the original side of the main garment panel and extending across the opening formed by the slit.

9. The method of forming the welt and flap for a pocket opening according to claim 8 wherein, said first and second rows of stitches are inserted simultaneously.

10. The method of forming the welt and flap for a pocket opening according to claim 9 wherein, the cutting of the slit is performed simultaneously with the sewing of the rows of stitches.

* * * * *